United States Patent [19]

Speil

[11] 4,211,516

[45] Jul. 8, 1980

[54] BLADE STRUCTURE FOR FLUID FLOW ROTARY MACHINE

[75] Inventor: Peter Speil, Heidelberg, Fed. Rep. of Germany

[73] Assignee: BBC Brown Boveri & Company Limited, Baden, Switzerland

[21] Appl. No.: 789,245

[22] Filed: Apr. 20, 1977

[30] Foreign Application Priority Data

Apr. 23, 1976 [DE] Fed. Rep. of Germany ..... 2617927

[51] Int. Cl.[2] ..... F01D 5/22

[52] U.S. Cl. ..... 416/191; 416/213 R; 416/236 A

[58] Field of Search ..... 416/236 A, 191, 213 R, 416/213 A, 189–192, 195, 232, 196

[56] References Cited

U.S. PATENT DOCUMENTS

| | | | |
|---|---|---|---|
| 2,278,041 | 3/1942 | Allen | 416/191 |
| 2,345,918 | 4/1944 | Dahlstrand | 29/156.8 |
| 2,350,125 | 5/1944 | Dahlstrand | 416/192 |
| 2,681,500 | 6/1954 | Whitehead | 29/156.8 |
| 2,920,865 | 1/1960 | Lombard | 416/95 X |
| 3,185,441 | 5/1965 | Reuter | 416/190 X |
| 3,339,889 | 9/1967 | Nyffeler | 416/213 |
| 3,575,523 | 4/1971 | Gross | 416/191 X |
| 3,626,568 | 12/1971 | Silverstein et al. | 29/156.8 H |
| 3,627,443 | 12/1971 | Pirzer | 416/213 X |
| 3,761,201 | 9/1973 | Silverstein et al. | 416/232 |

FOREIGN PATENT DOCUMENTS

| | | | |
|---|---|---|---|
| 1300577 | 8/1969 | Fed. Rep. of Germany | 416/191 |
| 2312671 | 12/1976 | France | 416/213 R |
| 7407721 | 12/1975 | Netherlands | 416/236 A |
| 733918 | 7/1955 | United Kingdom | 416/191 |

*Primary Examiner*—Everette A. Powell, Jr.

*Attorney, Agent, or Firm*—Burns, Doane, Swecker & Mathis

[57] ABSTRACT

A blade structure for use in a fluid flow rotary machine wherein the blade profile is thickened within the head region and a cover plate is connected to the head end within the thickened region by means of a substantially loop-shaped welded joint which is made by use of a high-energy beam such as an electron beam applied to the surface of the cover plate. The starting and end portions of the welding run can be overlapped, and the intensity of the welding beam is gradually increased from the starting point of the run to eliminate any swelling effect and is gradually reduced towards the end of the run to prevent crater formation.

7 Claims, 4 Drawing Figures

BLADE STRUCTURE FOR FLUID FLOW ROTARY MACHINE

BACKGROUND OF THE INVENTION

This invention relates to an improved construction for blading utilized in fluid flow rotary machines such as turbo-machines and wherein the blades have a profile which is thickened at least within its head portion and is provided there with a cover plate.

In one known construction for a blade of this general type, the cover plate is fastened to the head end of the blade by means of a riveted joint, with a peg formed at the blade end serving as a rivet. The machining of the parts required for making the joint is costly, and great care must be exercised in making the connection so as to avoid formation of any cracks or any break-off of the rivet peg.

SUMMARY OF THE INVENTION

The principal object of this invention is to provide an improved blade structure in which the connection between the head end of the blade and its cover plate is simplified, which as a result thereof is relatively inexpensive while still meeting all operational requirements.

The problem is solved in the manner that the cover plate forms a butt joint with the head end of the blade and is connected to the latter within the thickened region of the blade profile with the aid of an energy beam which forms at least one essentially loop-shaped welded joint. The outlay required for jointing is reduced substantially because there is no need for use of a peg on the blade, nor for a bore and counterbore at the cover plate. The welding operation performed with the aid of an energy beam, preferably in the form of an electron beam, within the thickened region of the blade profile results in a joint of great strength, and the shaping of the welded joint established by penetration of the thickened portion of the blade profile through the cover plate, in the form of a loop makes possible a welded joint of great length.

It is advantageous to establish the joint in the form of a nearly closed, or completed closed loop in order to make full use of the thickened region of the blade profile for the joint. An overlapping of the starting and end zones of the joint will be particularly expedient. This makes it possible to produce a welded joint of substantially identical strength throughout its entire length even if the starting zone of the joint is built up by an energy beam that rises gradually to its desired intensity, and which similarly decreases in intensity at the ending zone of the joint. This lowering of the beam intensity at both the starting and ending portions of the joint run will eliminate any swelling effect at the start of the joint and prevent crater formation at the end of the joint.

Formation of a welded joint having an elliptical configuration is particularly advantageous since the major axis of the ellipse can be oriented approximately in the direction of the longitudinal axis of the thickened portion of the blade profile, and preferably coincides with the same.

It will be advantageous to accomplish the connection between the blade and its cover plate in such manner that sufficient distance is maintained between the run of the welding joint and the external surface of the blade to prevent any detrimental influencing of the blade surface.

BRIEF DESCRIPTION OF DRAWINGS

The foregoing and additional advantages inherent in the invention will become more apparent from the following detailed description of preferred embodiments in conjunction with the appertaining drawings wherein.

DETAILED DESCRIPTION OF PREFERRED EMBODIMENTS

Figure 1:
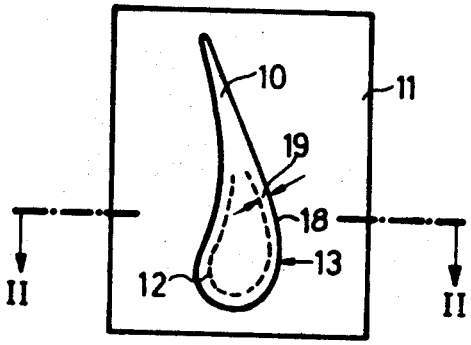
FIG. 1 is a view of a blade having an airfoil profile as seen from its foot portion looking in the direction of the head region with its cover plate attached to the head end by means of a welded joint having a nearly-closed loop-shaped configuration.
Figure 2:
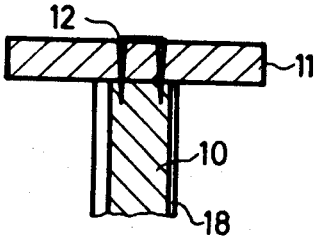
FIG. 2 is a vertical section of the blade taken on line II—II of FIG. 1.

With reference now to FIGS. 1 and 2, the blade structure 10 for a fluid flow rotary machine such as a turbomachine is seen to have an airfoil profile and is provided at its head end with a cover plate 11. The connection between these two parts is established by application of a welded joint 12 at the cover plate, the joint having a nearly closed loop-shaped configuration and which is applied at the thickened region 13 of the blade profile.

In order to connect the cover plate 11 with the blade structure 10, plate 11 is pressed against the head end of the blade by means of a suitable clamping arrangement, not illustraded, and the two clamped-together parts are placed within the vacuum chamber of an electron beam type welding machine. There the longitudinal axis of the head region of the blade is aligned approximately parallel to the axis of the welding beam, and the two parts are then welded together. During this operation the electron beam penetrates from the outside through cover plate 11 into the head region of the blade and the desired welded joint 12 is generated, as depicted in FIG. 2. When the welding operation is started, the intensity of the electron beam is preferably reduced to such an extent that any swelling of the material is avoided when the beam first strikes the surface of plate 11. After a short starting run of the joint, the intensity of the beam is then raised to the magnitude required for welding, and the main portion of the welded joint is then produced. During the end portion of the run, the beam intensity is again reduced to such an extent that end-craters in the joint are avoided when the beam is cut off. The starting and end portions of the run are kept as short as possible, relative to the main portion of the welded joint.

In order to establish a desired configuration for the welded joint, the electron beam is guided electromatically over the proper course. However in so guiding the beam, care should be taken that a certain distance 19 from the joint to the external surface 18 of the blade is maintained, this distance being sufficient to prevent any damage to, or detrimental influencing of the blade surface. Obviously, the welding operation can also be accomplished in a complementary manner, namely, in that the electron beam remains in a fixed position and the blade structure is moved through the desired path to establish the welded joint 12.

Figure 3:
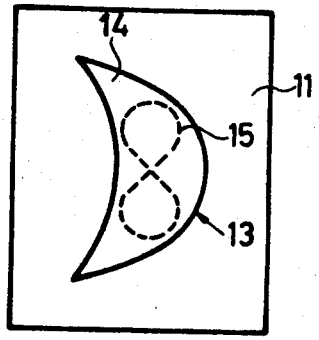
FIG. 3 is a view similar to FIG. 1 of a blade structure having a crescent profile with cover plate attached to the head end by means of a loop-shaped welded joint having a figure-eight configuration.

With reference to the embodiment illustrated in FIG. 3, the blade 14 is seen to have a crescent-shaped profile and wherein the head end is welded to cover plate 11 within the thickened region 13 of the blade profile by means of a welded joint in the form of a closed loop having a figure-eight configuration. This type of welded joint offers the advantage of a particularly good utilization of the thickened portion of the blade profile for accomplishing the connection between the two parts.

Figure 4:
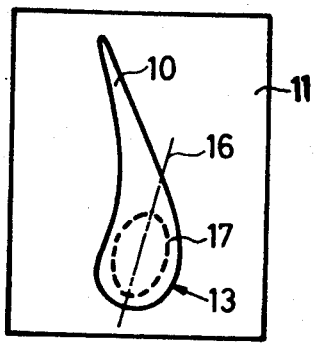
FIG. 4 is a view also similar to FIG. 1 having a similar profile and wherein the cover plate is attached to the head end of the blade by means of a loop-shaped welded joint having an elliptical configuration.

With reference to the embodiment illustrated in FIG. 4, the blade 10 is seen to have the same airfoil profile as in the embodiment of FIG. 1. Here, however, the welded joint 17 is in the form of a closed loop having an elliptical configuration. The major axis 16 of the ellipse extends approximately in the direction of the longitudinal axis of the thickened portion 13 of the blade profile and preferably coincides with the same.

I claim:

1. A blade structure for use in a fluid flow rotary machine comprising:

a blade having a profile which is thickened at least within an enlarged leading edge; and a cover plate connected to the blade at the blade head thickened region by at least one welded joint, the welded joint forming a substantially closed loop and having an elliptical configuration with the major axis of the elliptical welded joint extending approximately in the direction of the longitudinal axis of the thickened region of the blade profile, the welded joint including at least one looping welded seam arranged substantially within a periphery of the blade profile;

said looping welded seam being formed over only a portion of the blade profile and at least a portion of said looping welded seam being spaced from the periphery of the blade profile by a distance sufficient to prevent any detrimental influence thereon.

2. A blade structure as defined in claim 1 wherein the starting and end zones of said welded joint overlap.

3. A blade structure as defined in claim 1 wherein the blade contacts the cover plate substantially along the blade profile.

4. A blade structure as defined in claim 1 wherein the entire looping welded seam lies within the periphery of the blade profile.

5. A blade structure as defined in claim 1 wherein the entire looping welded seam is spaced from the periphery of the blade profile.

6. A blade structure as defined in claim 1 wherein the at least one looping welded seam is formed by electron beam welding.

7. A blade structure as defined in claim 1 wherein the at least one looping welded seam has a width, said width being narrow relative to the blade profile.

* * * * *